US007819305B2

(12) United States Patent
Little

(10) Patent No.: US 7,819,305 B2
(45) Date of Patent: Oct. 26, 2010

(54) MATERIALS FOR AND METHOD FOR MANUFACTURING PACKAGING AND RESULTING PACKAGING

(75) Inventor: Troy Little, Thomasville, PA (US)

(73) Assignee: York Container Company, York, PA (US)

( * ) Notice: Subject to any disclaimer, the term of this patent is extended or adjusted under 35 U.S.C. 154(b) by 249 days.

(21) Appl. No.: 12/121,414

(22) Filed: May 15, 2008

(65) Prior Publication Data

US 2009/0283580 A1 Nov. 19, 2009

(51) Int. Cl.
*B65D 5/32* (2006.01)
*B31B 7/00* (2006.01)

(52) U.S. Cl. ..... 229/122.32; 229/120.18; 229/199; 229/918; 493/89

(58) Field of Classification Search ..... 229/120.18, 229/122.32, 122.33, 199, 918, 919; 206/774; 493/89, 94, 96, 907
See application file for complete search history.

(56) References Cited

U.S. PATENT DOCUMENTS 2,894,672 A * 7/1959 Bamburg ..... 229/120.18
2,939,620 A * 6/1960 Royce ..... 229/122.32
3,034,698 A 5/1962 Forrer
3,048,318 A 8/1962 Sabin
3,236,433 A 2/1966 Barrett
3,373,921 A * 3/1968 Crane ..... 229/919
3,397,831 A 8/1968 Adams
3,696,990 A * 10/1972 Dewhurst ..... 229/117.16
3,912,159 A 10/1975 Danville
3,982,684 A 9/1976 David
4,056,223 A 11/1977 Williams
4,058,249 A * 11/1977 Buck ..... 229/120.18
4,068,796 A 1/1978 Kullman, Jr.
4,197,980 A 4/1980 Johnson
4,403,729 A * 9/1983 Wytko ..... 229/117.17
4,605,158 A 8/1986 Barton
4,874,125 A 10/1989 Bates
5,294,044 A 3/1994 Clark
5,350,109 A * 9/1994 Brown et al. ..... 229/117.16
5,375,715 A 12/1994 Serre et al.
5,400,955 A 3/1995 Coalier et al.
5,415,345 A 5/1995 MacKinnon
5,505,368 A 4/1996 Kanter et al.
5,520,325 A 5/1996 Quaintance
5,673,848 A 10/1997 Garza
5,791,555 A * 8/1998 Kanter ..... 229/164
5,853,120 A 12/1998 McLeod
5,947,292 A * 9/1999 Chelfi ..... 229/199
5,975,413 A 11/1999 Moen
5,979,746 A 11/1999 McLeod et al.
6,015,084 A * 1/2000 Mathieu et al. ..... 229/122.32
6,085,969 A * 7/2000 Burgoyne ..... 229/117.17
6,158,653 A 12/2000 Kanter et al.

(Continued)

FOREIGN PATENT DOCUMENTS

FR 2641758 A1 * 7/1990 ..... 229/199

*Primary Examiner*—Gary E Elkins
(74) *Attorney, Agent, or Firm*—Barnes & Thornburg LLP

(57) ABSTRACT

In accordance with the invention, a method of manufacturing packaging and resulting packaging and associated pre-assemblies and blanks are provided, which, when utilized, result in packaging that has increased side panel strength and corner strength so as to enable effective vertical stacking of packaging when the packaging includes product.

11 Claims, 6 Drawing Sheets

U.S. PATENT DOCUMENTS

| | | | | |
|---|---|---|---|---|
| 6,270,007 | B1 | 8/2001 | Jensen, Jr. | |
| 6,325,282 | B1 | 12/2001 | Kanter et al. | |
| 6,513,705 | B1 | 2/2003 | Sheffer | |
| 6,712,214 | B1 * | 3/2004 | Wintermute et al. | 229/199 |
| 6,817,514 | B2 | 11/2004 | Kanter et al. | |
| 6,874,679 | B2 | 4/2005 | Tibbles et al. | |
| 6,962,558 | B2 | 11/2005 | Dalrymple | |
| 7,066,379 | B2 | 6/2006 | McLeod et al. | |
| 7,290,696 | B2 | 11/2007 | McClure | |
| 2003/0146130 | A1 * | 8/2003 | Kanter et al. | 206/774 |
| 2005/0161496 | A1 | 7/2005 | McLeod et al. | |
| 2005/0242164 | A1 * | 11/2005 | Teixidor Casanovas | 229/918 |
| 2007/0108261 | A1 * | 5/2007 | Schuster | 229/199 |

* cited by examiner

MATERIALS FOR AND METHOD FOR MANUFACTURING PACKAGING AND RESULTING PACKAGING

The invention relates in general to the manufacture of packaging that may be readily used as to display the contents of the packaging following delivery of the packaging, as specified in the independent claims.

BACKGROUND OF THE INVENTION

Various packages and containers are conventionally provided for transporting product to and storing product in a retail environment and for display to prospective customers. As is conventionally known in the packaging industry, such packages can be transported to manufacturing and/or retail environments for display in knock-down form; i.e., flattened but otherwise being glued, stapled or otherwise secured together, such that they are already substantially pre-assembled; in such a knock-down state, personnel assembling the product display need only open the sides and or ends of the package and affix the package bottom wall into its assembled condition. As a result, such package assembly may be performed prior to loading manufactured product. Alternatively, such package assembly may be performed such that the product can be placed into a resulting assembled display package for ready display.

Conventionally, it has been deemed advantageous at times to stack a plurality of such packages, one on top of the other for the purposes of transport to a retail environment or during display in the retail environment. In this use, it is necessary that the packages stacked above the bottom-most package are amply supported also that a stack of a number of such packages, when filled with product, will not collapse.

SUMMARY

The following presents a simplified summary in order to provide a basic understanding of some aspects of various invention embodiments. The summary is not an extensive overview of the invention. It is neither intended to identify key or critical elements of the invention nor to delineate the scope of the invention. The following summary merely presents some concepts of the invention in a simplified form as a prelude to the more detailed description below.

In accordance with illustrated embodiments, a method of manufacturing packaging and resulting packaging and associated pre-assemblies and blanks, which, when utilized, results in a packaging that has increased side panel strength and corner strength so as to enable effective vertical stacking of packaging when the packaging includes product.

Additionally, in accordance with illustrated embodiments, the manufactured packaging provides the dual use of both a transporting container for transporting product to a retail environment and a display container configured to display the product in that retail environment. This is achieved by a combination of features recited in each independent claim. Accordingly, dependent claims prescribe further detailed implementations of the present invention.

BRIEF DESCRIPTION OF THE DRAWINGS

Various embodiments are described herein, by way of example only, with reference to the accompanying drawings. With specific reference now to the drawings, it should be understood that the particulars shown are by way of example and for purposes of discussion of illustrated embodiments only, and are presented in order to provide what is believed to be a useful and readily understood description of the principles and concepts of the invention. In this regard, no attempt is made to show structural details of the invention in more detail than is necessary for a fundamental understanding of the invention, the description taken with the drawings making apparent to those skilled in the art how the several forms of the invention may be embodied in practice.

Accordingly, a more complete understanding of the present invention and the utility thereof may be acquired by referring to the following description in consideration of the accompanying drawings, in which like reference numbers indicate like features, and wherein.

DETAILED DESCRIPTION OF THE INVENTION

Figure 1:
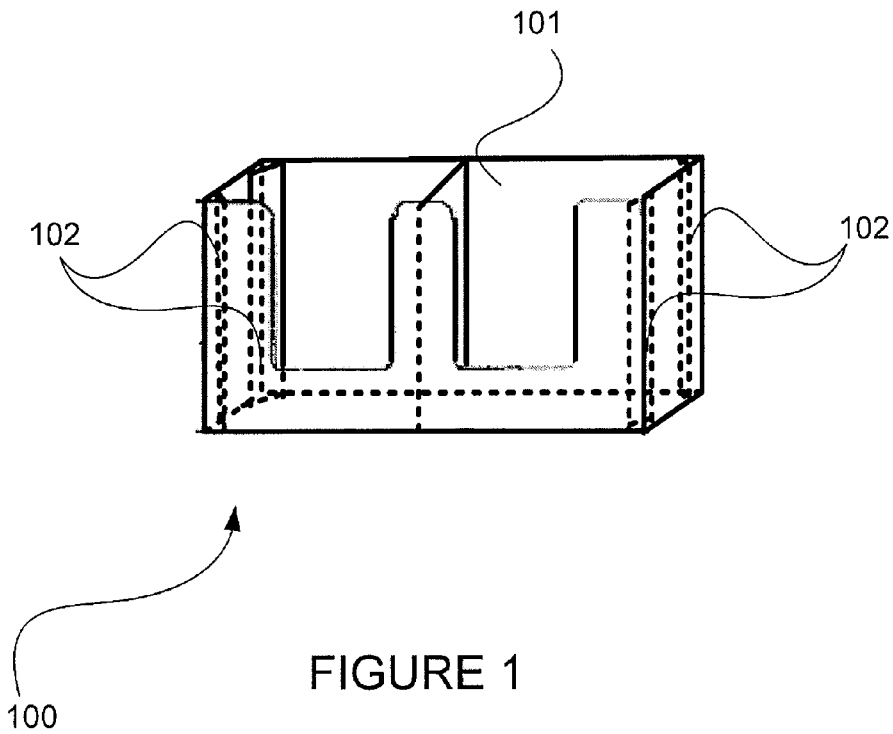
FIG. 1 illustrates a side perspective view of a package manufactured in accordance with an illustrated embodiment.

In the following description of various invention embodiments, reference is made to the accompanying drawings, which form a part hereof, and in which is shown, by way of illustration, various embodiments in which the invention may be practiced. It is to be understood that other embodiments may be utilized and structural and functional modifications may be made without departing from the scope and spirit of the present invention.

The manufacture and use of packages that may be used for more than one purpose, e.g., for transport of product and subsequent display of product in a retail environment, are becoming increasingly popular among both manufacturers and retailers because such packages enable a reduction or minimization of the amount of package material while increasing or maximizing the amount of display space available for product. Thus, it is conventionally known that blanks (e.g., made from some type of paperboard and/or other material that is die-cut and scored for subsequent manipulation to form a pre-assembly), pre-assemblies (e.g., a partially assembled package wherein the blank is manipulated and affixed to itself but is not fully assembled) and packaging (e.g., cartons, boxes, etc.) may be provided that enable product to be transported to a retail environment in a transporting package and displayed in the retail environment within the transporting package following minor modification of the transporting package.

The durability, strength and stackability of such packaging often requires increasing the amount of material content within the packaging. However, further reducing the amount of material content within packaging has become a significant goal of many manufacturers and retailers because of the adverse effect that packaging has on landfills and the environment in general as well as the cost of manufacturing, transporting and disposing of such packaging.

Thus, both manufacturers and retailers are recognizing a need to reduce the amount of packaging used to provide product to an end-consumer in a retail supply chain in an effort to conserve natural resources, reduce an impact on the environment and reduce costs associated with product manufacture and sale. In an effort to achieve these goals, various initiatives have been put in place by both suppliers and retailers to reduce overall product packaging by some percentage, e.g., five percent.

One conventional mechanism for reducing the amount of packaging necessary to provide product to potential consumers in a retail environment is by providing dual-use packaging wherein a package can be used both to contain product during transporting and also to display the product once that product has arrived in a retail environment, e.g., a store or other environment offering product for sale.

Further, in an effort to further use available space in a retail environment, retailers may be interested in using the display function of such dual-use packages in a manner such that packages may be stacked on top of one another to improve or optimize vertical space utility in the retail environment. Simply put, having the ability to be able to stack display cartons enables a store operator to present more product and/or different types of product in a manner that a customer can see. For example, by providing the opportunity to stack such packages, e.g., display cartons, on a counter, a store operator is able to increase the use of counter space such that more than one carton can occupy the same horizontal counter foot print. As is understood in the retail industry, such a configuration increases sales because customers are able to see more available product and product types for sale.

However, a problem with stacking such display cartons, whether such cartons be dual-use transporting/display packages or otherwise, is that the weight of the carton(s) in combination with the weight of the product(s) stored in the carton (s) can cause one or more cartons to be damaged or collapse. As a result, a store operator is left with damaged, ineffective or completely non-functioning display carton(s), which causes operational problems and reduces likelihood of sales to consumers.

Accordingly, based on all of these factors, there is a need to provide a method of manufacturing reduced material content packaging and resulting packages and associated pre-assemblies and blanks, which, when utilized, results in a package that provides the dual use of both as a transporting container for transporting product to a retail environment and a display container configured to display the product in that retail environment and has significantly improved stacking strength over conventional packaging.

With this understanding of one area of packaging utility in mind, a description of various invention embodiments is now provided.

According to as least one illustrated embodiment, there is provided equipment configured to manufacture dual-use packages, e.g., for transporting product and subsequent display of the product (as well as corresponding package pre-assemblies and blanks) that include a reduced amount of material content while maintaining or increasing the stacking strength of such packages. In view of recent retailer initiatives to reduce the amount of material content in packaging, such packages may have increased utility to manufacturers and retailers.

Understanding of the manufacturing of a package, blanks and/or pre-assemblies in accordance with invention embodiments may best be understood by first reviewing an illustration of a manufactured package provided in accordance with one illustrated embodiment. As illustrated in FIG. 1, one example of such a package 100 may include one or more auxiliary support sections 102 affixed at the corners of a box 101, which in this illustrated example is a dual-use package of the type referred to in the packaging industry as a half regular, fifth panel carton with cut-outs for display purposes (however, it should be understood that the manufactured package may be any type of carton, package, box, etc. of any suitable type. As used in FIG. 1 (and FIG. 6), solid lines indicate those edges visible from the illustrated perspective and dashed lines indicate those edges not visible from the illustrated perspective.

As will be appreciated from the remaining disclosure by one of ordinary skill in the art, the box 100 may be used for transport of product therein when a top and the side cut-outs are in place. Subsequent to arrival at a retail environment, for example, the top and side cut-outs may be removed to provide a display for product included therein.

Figure 2:
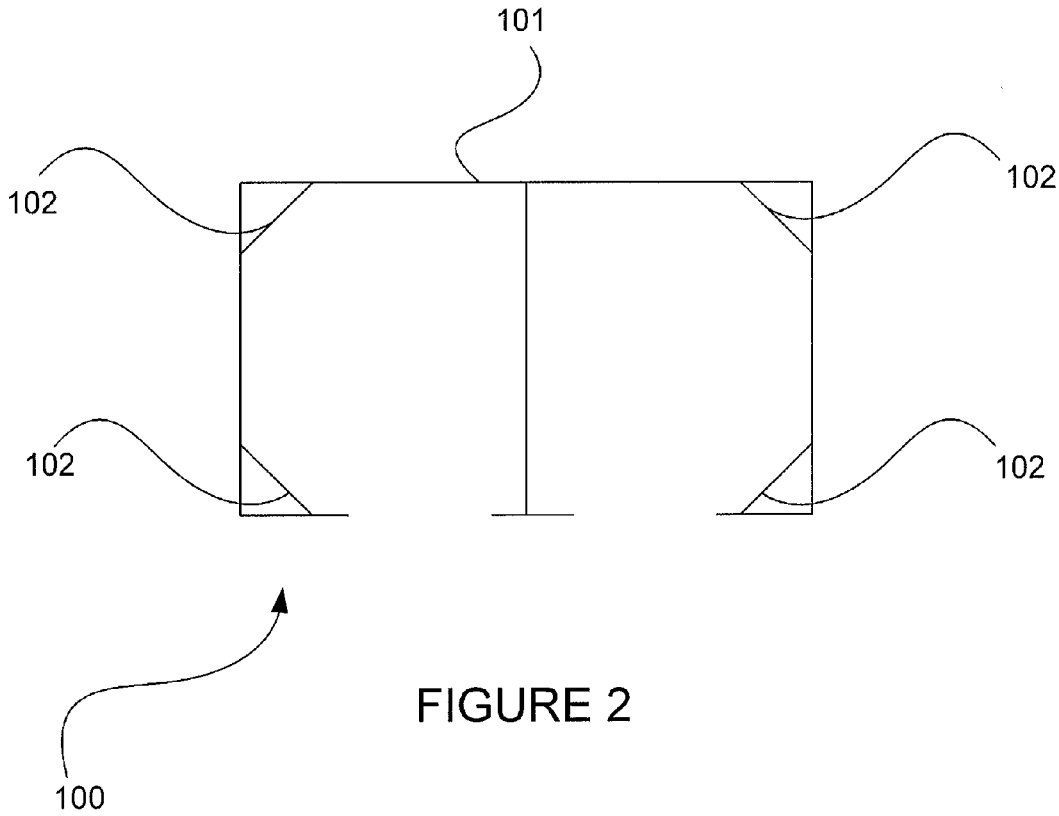
FIG. 2 illustrates a top view of the package illustrated in FIG. 1.

FIG. 2 provides a top view of the package 100, illustrated in FIG. 1. As shown in FIG. 2, the auxiliary support sections 102 are configured so as to be provided at comers of box 101. As explained in connection with FIG. 5, the auxiliary support sections 102 are hingedly connected (e.g., coupled together so as to allow alteration of the angle therebetween) to a central portion (245 illustrated in FIG. 5) that is affixed to lateral sides of the box 101. In an illustrated embodiment, the auxiliary support sections 102 are formed by bending the auxiliary support sections along the line that separate the sections 102 from the central portion.

Figure 3:
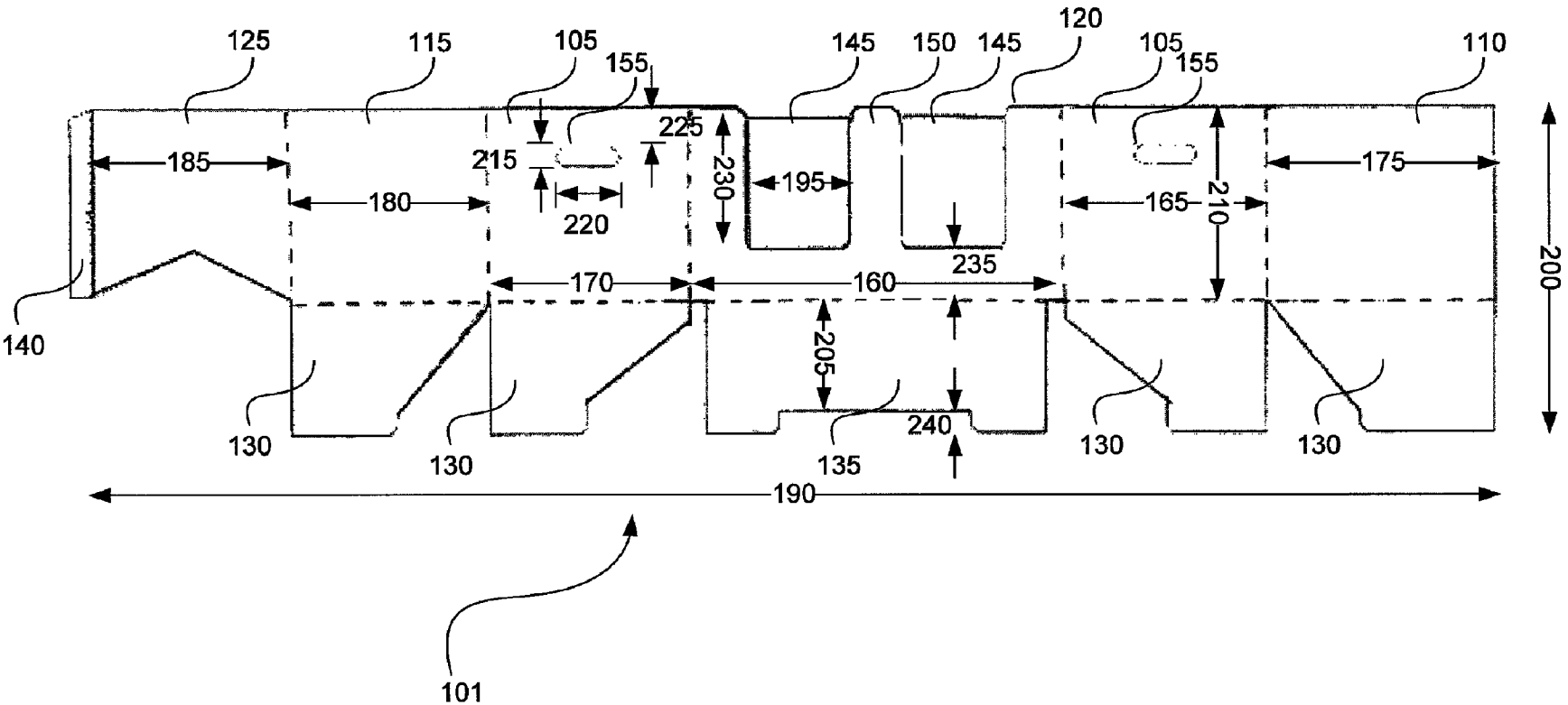
FIG. 3 illustrates an example of a blank used in manufacturing the package of the type illustrated in FIG. 1.

FIG. 3 illustrates an example of a blank for what is conventionally known as a half regular slotted bottom, fifth-panel carton such as the one illustrated in FIG. 1. As used in FIG. 3 (and FIGS. 4-5), solid lines indicate edges of the blanks illustrated whereas dashed lines indicate perforation, folding or scoring lines provided as part of manufacturing to enable folding of the blanks along the dashed lines.

The blank illustrated in FIG. 3 corresponds to the box 101 illustrated in FIGS. 1-2; therefore, for convenience, the box and blank will both be referred to using reference numeral 101.

The blank 101 includes five side panels: two side panels 105, a first back panel 110 and second back panel 115 (which overlap to form the back panel of the box 101), a front panel 120 and a divider panel 125 that divides the box 101 into two separate compartments and provides added stackability when the box 101 is assembled.

Figure 6:
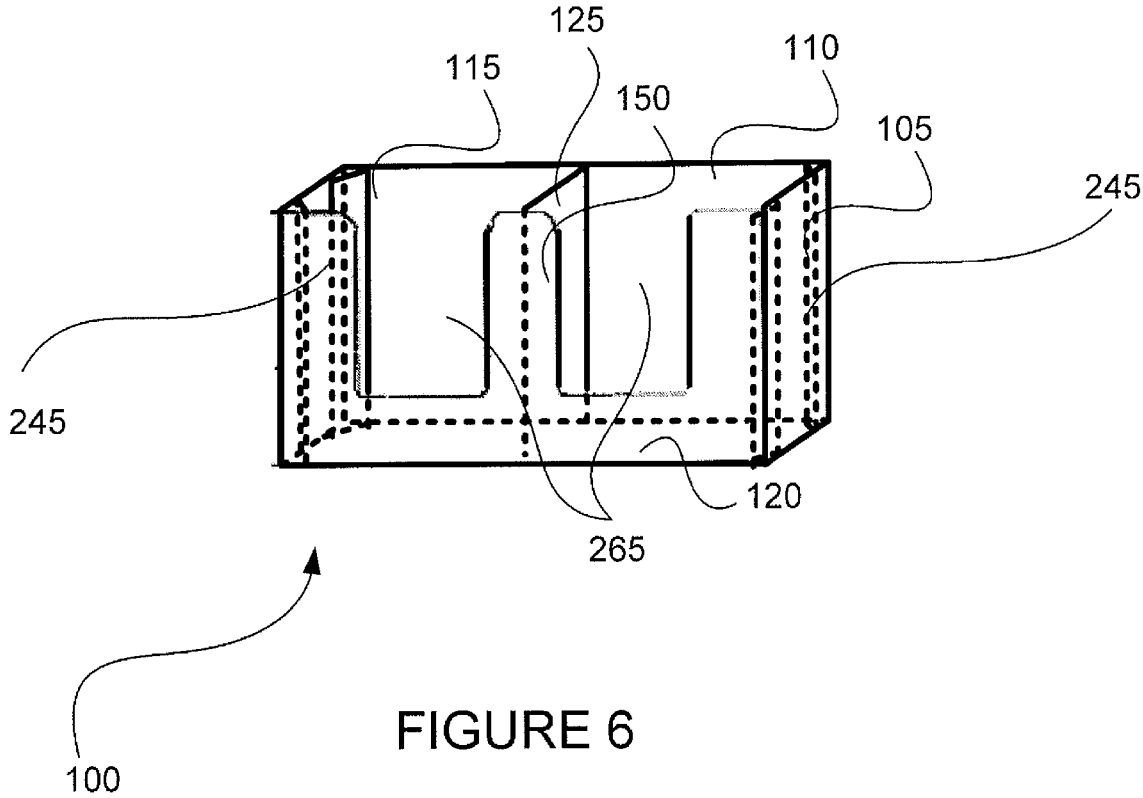
FIG. 6 illustrates a side perspective view of the package illustrated in FIG. 1 with additional detail.

The blank 101 also includes five bottom sub-panels 130, 135, which cooperate and interact to form a bottom panel when the box 101 is assembled. As part of pre-assembly manufacturing, the first back panel 110 and the second back panel 115 are positioned so as to partially overlap and adhesive is applied to one or both sides of the overlapping areas so as to affix the overlapping areas to one another. Also, as part of that pre-assembly manufacturing, the side panels 105-120 are folded in on themselves to form a shell and adhesive is applied to an adhesive panel 140 neighboring the divider panel 125. The adhesive panel 140 is used to couple the proximate end of the divider panel 125 to the interior side of the front panel 120, e.g., horizontally bisecting an area 150 between the two display cut-outs 145 provided in front panel 120. The two display cut-outs 145 may be removed to provide access openings (265 as illustrated in FIG. 6), defined by substantially U-shaped cut-outs in the front panel 120 of the package 100, for ready access to product displayed in the package 100. These cut-outs 145 may be in communication with the open top end of the package 100, which (during use as a display) is free of any top wall or panel following modification of the package 100 for the display function of the dual-use package. Thus, the removable access panels or cut-outs 145 included in the front panel 120 (and optionally a top panel not shown) may be readily removable therefrom once transport of the package 100 is completed by separating the cut-outs 145 from the front panel 120 along pre-cut score lines to enable easy display of the product contained in the package 100 and use of the package 100 as a display of the product.

Figure 4:
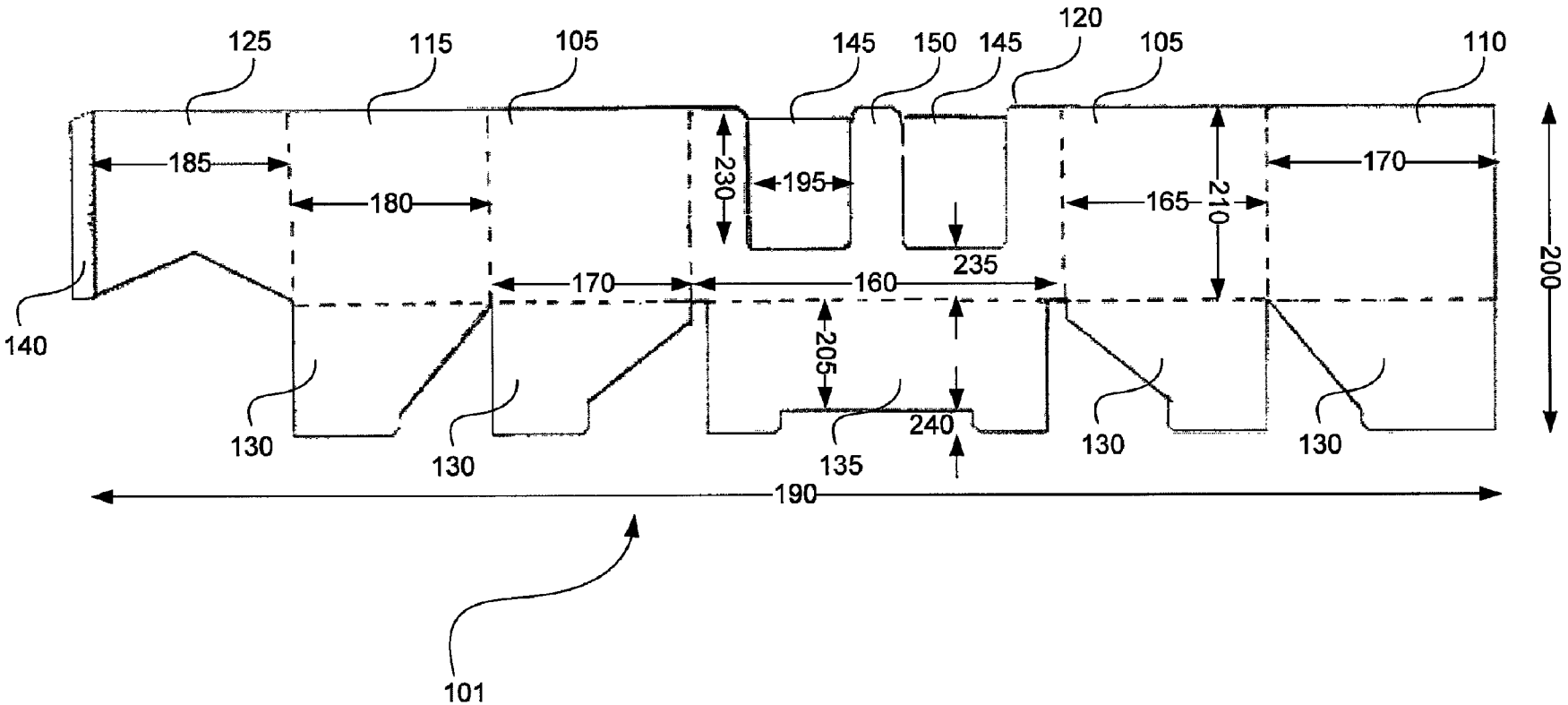
FIG. 4 illustrates another example of a blank used in manufacturing the package of the type illustrated in FIG. 1.

The blank 101 may include scored holes 155 for enabling an individual to carry the box 101 once assembled. Alternatively, as illustrated in FIG. 4, the scored holes 155 may be omitted.

Although it should be understood that both the type of box formed in accordance with the invention as well as the dimensions of the box 101 and corresponding package are not determinative of the utility of the invention, the following explanation of one example of the relative dimensions are provided so as to disclose one example of the dimensions of a blank 101 used in conjunction with the illustrated embodiment. However, it should be understood that the component dimensions disclosed herein (both relative to other disclosed component dimensions and absolute dimensions of the resulting package) are not limiting but merely illustrative.

Thus, the blank 101 has various width dimensions including the width 160 (e.g., 23.25 inches or 59.1 cm) of the front panel 120, the width 165, 170 (e.g., 12.75 inches or 32.4 cm for one side panel and 12.625 inches or 32.1 cm for the other side panel) of the side panels 105, the width 175 (e.g., 14.5 inches, 36.8 cm) of the first back panel 110, the width 180 (e.g., 11.9375 inches or 30.3 cm) of the second back panel 115, the width 185 (e.g., 12.5 inches or 31.8 cm) of the divider panel 125, the total width 190 (e.g., 88.5625 inches or 224.9 cm) of the blank 101, and the width 195 (e.g., 6.375 inches or 16.2 cm) of the cut-out 145. Likewise, the blank 101 has various length dimensions including the length 200 (e.g., 18.5 inches or 47 cm) of the first back panel 110 in combination with the length of the bottom panel 130, the length 205 (e.g., 6.25 inches or 15.9 cm) of the bottom panel 135, the length 210 (e.g., 11 inches or 27.9 cm) of the side panels 105, the length 215 (e.g., 1 inch or 2.5 cm) of the scored hole 155 (as opposed to the width 205, e.g., 4 inches or 10.2 cm, of the hole 155, if included in the blank 101), the length 225 (e.g., 2.25 inches or 5.7 cm) between the top edge of the side panel 105 and the scored hole 155, the length 230 (e.g., 8 inches or 20.3 cm) of the cut-out 145, the length 235 (e.g., 3 inches or 7.6 cm) between the bottom edge of the front panel 120 and the cut-out 145 and the length 240 (e.g., 1.25 inches or 3.2 cm) of the indentation on the edge of the bottom panel 135.

Figure 5:
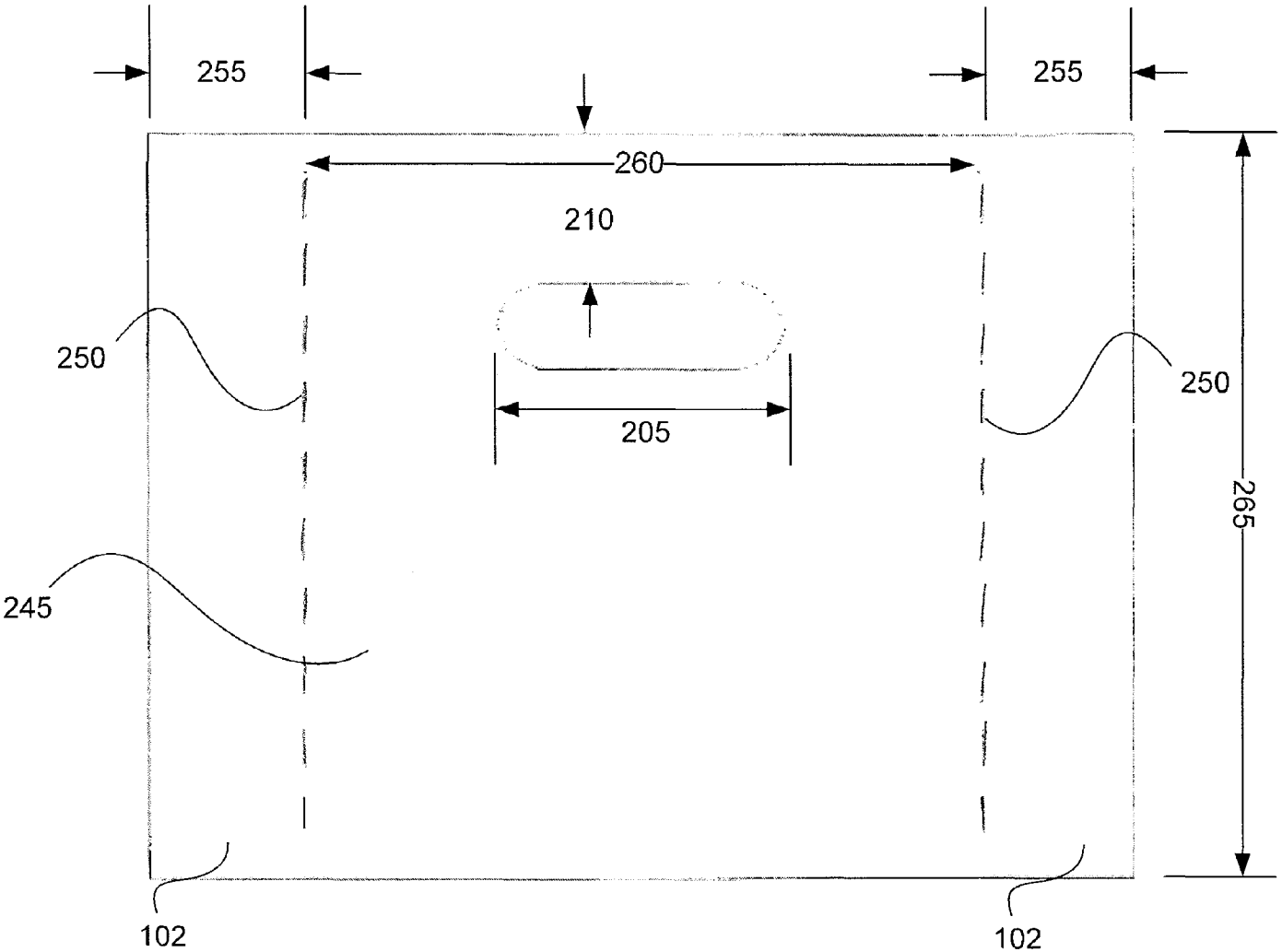
FIG. 5 illustrates another example of a blank used in manufacturing the package of the type illustrated in FIG. 1.

FIG. 5 illustrates an example of second type of blank 245 used to provide the auxiliary support sections 102 illustrated in FIG. 1. The auxiliary support sections 102 are divided from the remaining width of the blank 245 by scoring lines 250 that enable bending of the material of the blank 245 along the lines 250. This deformation or bending of the blank 245 enables the entire width of the blank 245 to fit in the interior confines of the box 101 substantially parallel to the side panels 105 although the width dimensions of the blank 245 (i.e., widths 255, e.g., 2.25 inches or 5.7 cm, and width 260, e.g., 10 inches or 25.4 cm, for a total of 14.50 inches or 36.8 cm) are greater than that of the side panels 105 (e.g., approximately 12.5 inches or 31.8 cm). Although the blank 145 includes the slotted hole opening for overlapping the scored hole opening 155 illustrated in FIG. 3, there scored hole opening of blank 245 may be omitted if the blank 101 does not include corresponding scored hole openings.

As part of manufacturing, a portion of the lateral face of the blank 245 is affixed to one or both of the interior faces of the side panels 105. The faces may be affixed in one or more suitable manners including application of adhesive on one or both of the affixed faces, use of staples, tape, etc. The portion of the blank's 245 lateral face affixed to the side panel 105 includes at least some or all of the portion of the blank 245 spanning the width 260 (i.e., the central portion), thereby leaving the widths 255 to remain free to bend back towards the interior of the manufacture preassembly of the box 101. Accordingly, the auxiliary support sections are bent back towards the interior of the box 101 and make contact with the neighboring sides of the box 101, e.g., the front panel 120 or the back panels 110, 115, as illustrated in FIG. 6 (showing a fully assembly package 100). Thus, each of the auxiliary support sections 102 are affixed at one lateral end thereof to the corresponding side panel and rigidly (e.g., without bending or substantial deformation) abut either the front or back panel at the other lateral end of the auxiliary support section.

The package 100 is thus formed in a rectangular configuration, with the side panels 105 and back panels 110, 115 and front panel 120 forming a pair of opposing walls. Further, the package includes both increased strength on the side panels by the span 260 of blank 245 affixed to the side panels 105 and the inclusion of the auxiliary support sections 102 at the corners of the box 101 wherein the various side panels intersect.

Although FIGS. 1-6 illustrate one example of a package that may be manufactured in accordance with illustrated embodiments, various different types of blanks and pre-assemblies may be used to produce various different types of packages. Thus, although one or more of the side panels may be configured in a rectangular shape, various other shapes are also suitable. Further, although not illustrated in FIGS. 1-6, a blank used to construct a box included in the package may also include a top panel of various suitable shapes and sizes.

Figure 7:
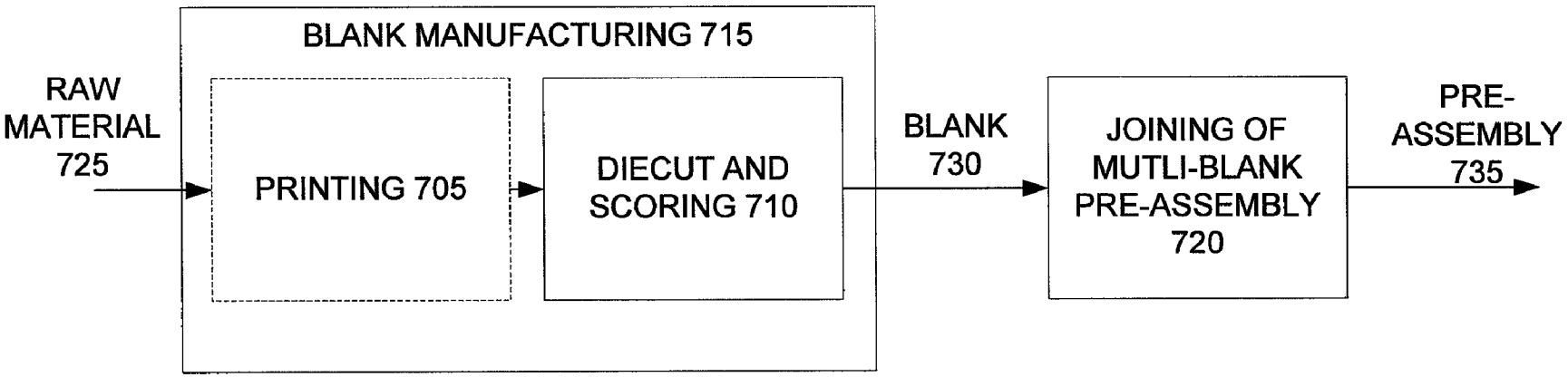
FIG. 7 illustrates a functional block diagram used to describe the manufacturing method of packages in accordance with an illustrated embodiment.

FIG. 7 illustrates a functional block diagram showing the operation of various method functions performed in accordance with a method of producing pre-assemblies in conjunction with illustrated embodiments. With regard to the manufacturing of packages such as the one illustrated in FIGS. 1-6, the manner of manufacturing such packages may be conveniently described in two phases: pre-assembly and final assembly/use.

Pre-assembly is normally performed at a package manufacturing facility to produce a pre-assembly which may also be thought of and referred to as a knock-down of the package. These pre-assemblies may be shipped to a customer location such as a product manufacturing facility. At the product manufacturing facility, the customer may perform final assembly/use of the packages by, for example, folding and assembling various panels of the package to provide a package that is configured to hold manufacture product, e.g., for shipping and/or display.

In such operations, the labelling of the resulting packages may be performed by the customer of the pre-assemblies and/or as part of manufacture of the pre-assemblies as illustrated in FIG. 7.

FIG. 7 illustrates various functional operations performed as part of the manufacture of a pre-assembly by, for example, a package manufacturer. The operations may begin, for example, with printing 705 of package material prior to the package material being diecut and/or scored 710 as part of an overall blank manufacturing operation 715. The manufactured blanks 730 may or may not be printed on one or both sides of the blanks 730 depending on customer requirements. Accordingly, the printing operation 705 may be omitted.

Subsequent, to blank manufacturing 705, multi-blank pre-assembly operations may be performed in various suitable manners by hand or using various commercially available machines (for example, those produced by Bahmueller Technologies, Inc. of Charlotte, N.C., USA or Bobst Group North America of Roseland, N.J., USA), to produce pre-assemblies for reinforced packaging such as that illustrated in FIG. 1, for example.

Thus, at the beginning of such operations, raw material 725 is used to produce blanks 730. Such raw materials 725 may include but are not limited to various grades, types, configurations and combinations of corrugated fiberboard and/or solid paperboard, liner board, board of various fluting types and combinations as well as various types of sealants, non-organic materials and inks and dies of various suitable types.

It should be understood that implementation of the method and system of the present invention involves performing or completing certain selected tasks or steps manually, automatically, or a combination thereof.

While this invention has been described in conjunction with the specific embodiments outlined above, it is evident that many alternatives, modifications and variations will be apparent to those skilled in the art. Accordingly, the various embodiments of the invention, as set forth above, are intended to be illustrative, not limiting. Various changes may be made without departing from the spirit and scope of the invention.

It should be understood that invention embodiments are capable of variations practiced or carried out in various ways. Therefore, it should be appreciated that, in accordance with at least one embodiment of the invention, any and all of the walls may be constructed of corrugated cardboard. However, it should be understood that the walls, panels, any tabs on various panels, etc., may be constructed of various industry recognized appropriate materials that meet various transporting and/or display criteria. As a result, it should be understood that packages manufactured in accordance with at least one embodiment of the invention may also be considered "cartons," which may be considered packaging containers, commonly made from cardboard. Further, it should be understood that cartons come in many different varieties but most cartons can be folded and assembled from a flat form, known as a carton blank. Thus, it should be understood that the pattern for any blank, pre-assembly or package may be different than those described herein.

Alternatively, or more specifically, the packaging containers may be made using corrugated board, e.g., material made by a corrugator (a machine that produces corrugated board by attaching fluting to liners) which is a structured board formed by gluing one or more arched layers of corrugated medium to one or more flat-facing linerboards.

Additionally, it should be appreciated that material used in accordance with at least one embodiment of the invention may be laminated to provide barrier properties. Further, other barrier materials may be used including Ultra Violet (UV), moisture and gas barriers. Additionally, though not discussed in detail herein, it should be understood that any adhesive used to provide a bond between materials used in packages provided in accordance with the invention may include any substance that helps bond two materials together, examples including but not limited to glue and paste.

It should also be appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

Additionally, it should be understood that the functionality described in connection with various described components of various invention embodiments may be combined or separated from one another in such a way that the architecture of the invention is somewhat different than what is expressly disclosed herein. Moreover, it should be understood that, unless otherwise specified, there is no essential requirement that methodology operations be performed in the illustrated order; therefore, one of ordinary skill in the art would recognize that some operations may be performed in one or more alternative order and/or simultaneously.

As a result, it will be apparent for those skilled in the art that the illustrative embodiments described are only examples and that various modifications can be made within the scope of the invention as defined in the appended claims.

The invention claimed is:

1. A method of manufacturing dual-use display-ready pre-assembly, the method comprising:

cutting a first blank including a front panel, a first back panel, a second back panel two side panels, a divider panel, five bottom panels, and an adhesive panel;

cutting a plurality of second blanks, each second blank including a central portion and a plurality of auxiliary support sections divided from the central portion by scoring lines;

affixing the central portion of each of the second blanks to a corresponding side panel of the first blank;

folding the two side panels in on themselves to form a shell and applying adhesive to the adhesive panel to couple the divider panel to an interior side of the front panel, and two of the auxiliary support sections are bent back on themselves along their respective scoring lines;

positioning the first and second back panels to partially overlap each other and affixing adhesive to one or both of the back panels to affix them to one another to complete manufacture of the pre-assembly; and wherein, when the pre-assembly is finally assembled as a packaging, two of the auxiliary support sections that have not been bent back on themselves automatically rigidly and diagonally abut either the front or one of the back panels.

2. The method of claim 1, wherein the side panels of the first blank and the corresponding central portions of the second blanks are affixed to one another via application of an adhesive.

3. The method of claim 1, wherein the front panel of the first blank further includes at least one perforated section removable to provide an access opening for the package.

4. The method of claim 1, wherein the side panels of the first blank each include perforated sections removable to provide hand grips for the package.

5. The method of claim 1, wherein each second blank includes a perforated section removable to provide a hand grip for the package.

6. The method of claim 1, further comprising printing at least one image or color on at least one side of the first blank.

7. A plurality of blanks forming a pre-assembly, the pre-assembly comprising:

a first blank including a front panel, a first back panel, a second back panel, two side panels, a divider panel, five bottom panels and an adhesive panel;

a plurality of second blanks each including a central portion and a plurality of auxiliary support sections divided from the central portion by scoring lines;

the central portion being affixed to one of the side panels of the first blank;

the two side panels being folded on themselves to form a shell and the divider panel being coupled to an interior side of the front panel via the adhesive pad, and two of the auxiliary support sections being bent back on themselves along their respective scoring lines, and wherein, when the pre-assembly is finally assembled as a packaging, two of the auxiliary support sections that have not been bent back on themselves automatically rigidly and diagonally abut either the front or one of the back panels; and the first and second back panels positioned to partially overlap each other and one or both of the back panels being affixed to one another to complete manufacture of the pre-assembly.

8. The plurality of blanks of claim 7, wherein the front panel of the first blank further includes at least one perforated section removable to provide an access opening for the package.

9. The plurality of blanks of claim 7, wherein the side panels of the first blank each include perforated sections removable to provide hand grips for the package.

10. The plurality of blanks of claim 7, wherein the second blank includes a perforated section removable to provide a hand grip for the package.

11. The plurality of blanks of claim 7, wherein at least one side of the first blank is imprinted with at least one image or color.

* * * * *